US006377773B1

(12) United States Patent
Berkes et al.

(10) Patent No.: US 6,377,773 B1
(45) Date of Patent: Apr. 23, 2002

(54) EFFICIENT HEATING OF INTERMEDIATE TRANSFUSE MEMBER

(75) Inventors: John S. Berkes, Webster; Rabin Moser, Victor, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/745,153

(22) Filed: Dec. 20, 2000

(51) Int. Cl.[7] ..... G03G 15/16
(52) U.S. Cl. ..... 399/307
(58) Field of Search ..... 399/307, 329, 399/297

(56) References Cited

U.S. PATENT DOCUMENTS 4,455,079 A * 6/1984 Miwa et al.
5,164,782 A * 11/1992 Nagayama et al.
5,752,148 A * 5/1998 Yoneda et al. ..... 399/329
5,933,694 A * 8/1999 Yamashita et al. ..... 399/307 X
6,088,565 A 7/2000 Jia et al. ..... 399/302
6,141,524 A * 10/2000 Berkes et al. ..... 399/307
6,198,902 B1 * 3/2001 Vaughan et al. ..... 399/329
6,246,858 B1 * 6/2001 Condello et al. ..... 399/329
6,259,880 B1 * 7/2001 Jia et al. ..... 399/307
6,263,183 B1 * 7/2001 Schlueter, Jr. et al. ..... 399/329

* cited by examiner

*Primary Examiner*—Susan S. Y. Lee
(74) *Attorney, Agent, or Firm*—Mark Z. Dudley

(57) ABSTRACT

Efficient and uniform heating of a thick transfuse member, wherein the transfuse member is constructed in the form of a transfuse belt that is subject to heating at both front and rear surfaces. An elongated cavity is defined by a portion of the path of the transfuse belt about a plurality of guide rollers. Front surface heating is accomplished by use of a heated roller and rear surface heating is accomplished by use of a heat source situated within the cavity. The majority of the cavity is enclosed by the transfuse member and the guide rollers. Substantially all of the output of the heat source is efficiently transferred to the transfuse member and little or none of the heat produced by the heat source is lost to other components or structures.

13 Claims, 2 Drawing Sheets

EFFICIENT HEATING OF INTERMEDIATE TRANSFUSE MEMBER

Figure 1:
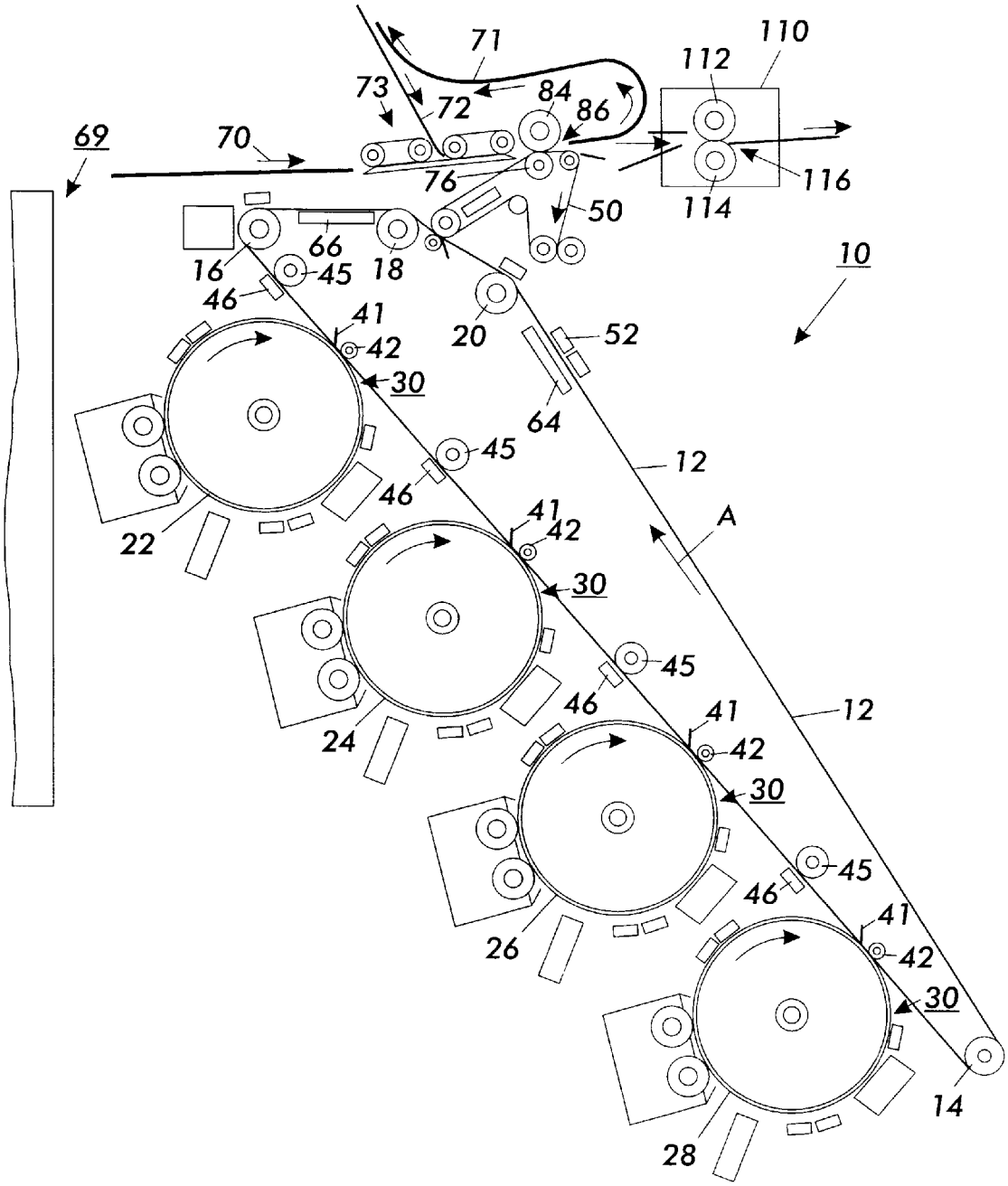

This invention relates to electrostatographic printing machines, and more particularly this invention relates to an electrostatographic printing machine that performs transfuse of a toner image to a substrate.

Electrostatographic printers are known in which an image bearing member is used to develop multiple color toner images. Each color toner image is electrostatically transferred in layers from the image bearing members and registered to an intermediate transfer member. The composite toner image is electrostatically transferred to the final substrate. Such systems use electrostatic transfer to transfer the composite toner image from the intermediate to the final substrate and then subsequently fix the image on the substrate in a fusing system.

For example, with reference to commonly-assigned U.S. Pat. No. 6,088,565, the disclosure of which is incorporated herein by reference, electrostatographic printing machine is disclosed having multiple toner image producing stations, each forming a developed toner image of a component color. The developed toner images are electrostatically transferred at the first transfer nip to an intermediate transfer member to form a composite toner image thereon. The composite toner image is then transferred electrostatically and with rheological assist at the second transfer nip to a transfuse member. The transfuse member preferably has improved conformability and other properties for improved transfusion of the composite toner image to a substrate. The second transfer member is maintained at a selected temperature relative to the glass transition temperature of the composite toner image at the second transfer nip. The composite toner image and the substrate are brought together in the third transfer nip to generally simultaneously transfer the composite toner image and fuse the composite toner image to the substrate to form a final document.

The use of an intermediate member allows electrostatic transfer in the first transfer nip to suppress transfer of background toner from the image bearing member. The intermediate transfer member can be selected to have a low affinity for receiving background toner.

In addition the intermediate transfer member thermally isolates the image bearing member from the heat of the transfuse member. Therefore the transfuse member can operate at a relatively higher temperature without the potential to damage the image bearing members. Because the transfuse member can be maintained at a higher temperature, the transfuse member can be relatively thick.

Thick transfuse members are generally preferred over thin members for a number of reasons. For example release of melted toner and stripping of a copy sheet from a toner fixing surface can be significantly helped by employing shear stresses in the fixing surface in the high pressure third transfer nip that are generally referred to as "creep". A thick rubber over layer is also desired for creating a high degree of conformance to enable good transfer and fix in the third transfer nip when rough papers are used. A thick transfuse belt thus generally has more media latitude than a thin transfuse belt. Thick transfuse members are also desired over thin members for achieving higher operational life. Finally, thick over layers are highly advantaged for transfuse systems that achieve low gloss in the third transfer nip and employ an optional post transfuse gloss enhancing system to allow operators to optionally choose high or low gloss print output.

However, efficient and uniform heating of a thick transfuse member can be difficult.

Accordingly, an improved system for efficient and uniform heating of a transfuse member may be constructed according to the present invention wherein the transfuse member is provided in the form of a transfuse belt that is subject to heating at both front and rear surfaces. Front surface heating is accomplished by use of a heated roller and rear surface heating is accomplished by use of a heat source situated within a heated cavity that is defined by the path of the transfuse belt about selected rollers.

Figure 2:
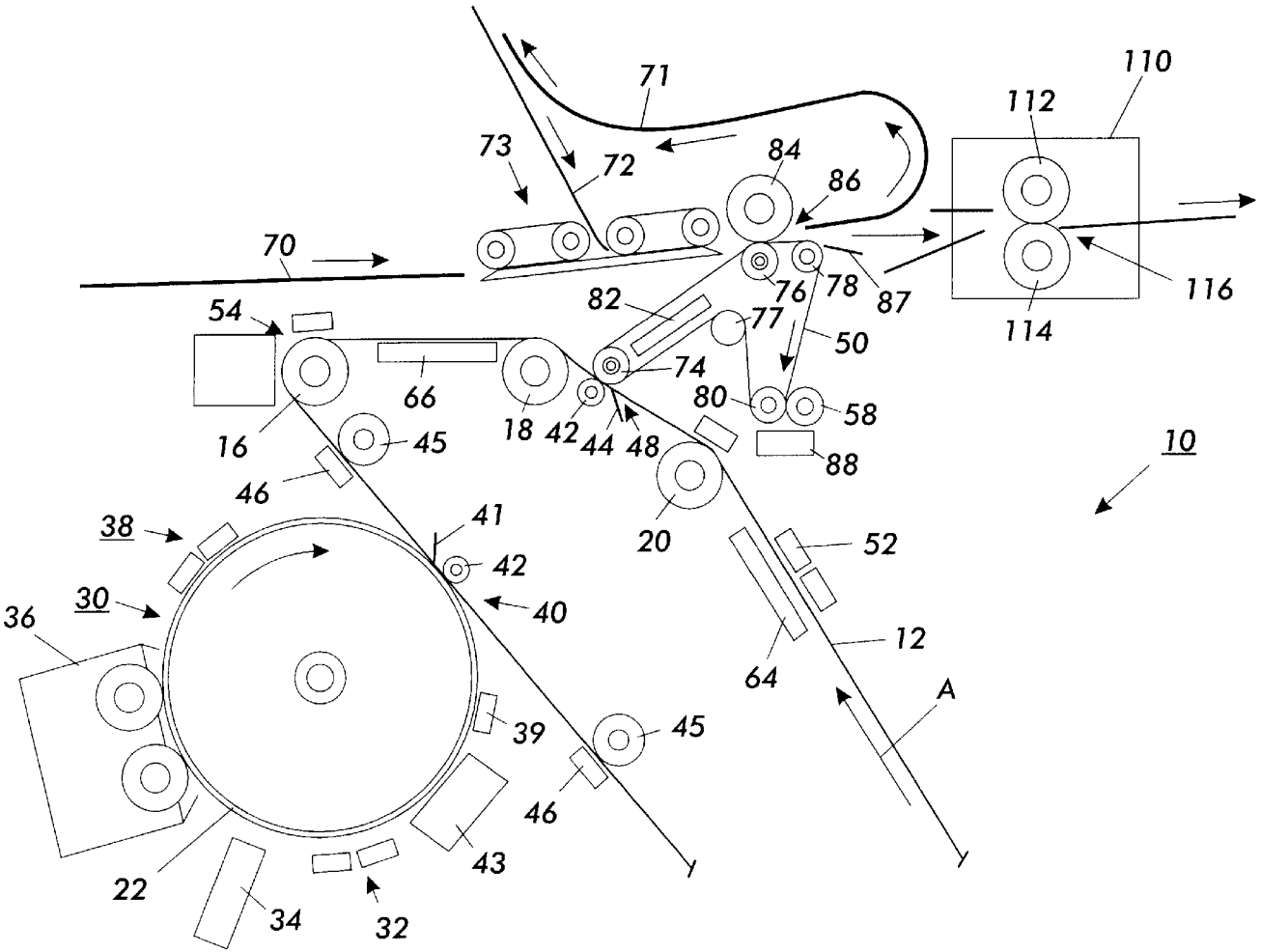

FIG. 1 is a schematic side view of a duplex cut sheet electrostatographic printer in accordance with the invention; and FIG. 2 is an enlarged schematic side view of the transfer nips of the printer of FIG. 1.

With reference now to FIGS. 1 and 2, a printing apparatus in the form of a multi-color cut sheet duplex electrostatographic printer 10 has an intermediate transfer belt 12 driven over guide rollers 14, 16, 18, and 20. The intermediate transfer belt 12 moves in a process direction shown by the arrow A. For purposes of discussion, the intermediate transfer member 12 defines a single section of the intermediate transfer member 12 as a toner area. A toner area is that part of the intermediate transfer member which receives the various processes by the stations positioned around the intermediate transfer member 12. The intermediate transfer member 12 may have multiple toner areas; however, each toner area is processed in the same way.

The toner area is moved past a set of four toner image producing stations 22, 24, 26, and 28. Each toner image producing station operates to place a color toner image on the toner image of the intermediate transfer member 12. Each toner image producing station operates in the same manner to form developed toner image for transfer to the intermediate transfer member 12. The toner image producing stations 22, 24, 26, 28 are described herein in terms of a photoreceptive system, but it is readily recognized by those of skill in the art that ionographic systems and other marking systems can readily be employed to form developed toner images. Each toner image producing station 22, 24, 26, 28 has an image bearing member 30. The image bearing member 30 is a drum or belt supporting a photoreceptor.

The image bearing member 30 is uniformly charged at a charging station 32. An exposure station 34 exposes the charged image bearing member 30 in an image-wise fashion to form an electrostatic latent image at the image area. For purposes of discussion, the image bearing member defines an image area. The image area is that part of the image bearing member which receives the various processes by the stations positioned around the image bearing member 30. The image bearing member 30 may have multiple image areas; however, each image area is processed in the same way.

The exposure station 34 exposes a light image representation of one color component of a composite color image onto the image area to form a first electrostatic latent image. Each of the toner image producing stations 22, 24, 26, 28 will form an electrostatic latent image corresponding to a particular color component of a composite color image.

The image area is advanced to a developer station 36 having a developer corresponding to the color component of the composite color image. Typically, therefore, individual toner image producing stations 22, 24, 26, and 28 will individually develop the cyan, magenta, yellow, and black that make up a typical composite color image. The image area having the component toner image then advances to the pre-transfer station 38 which preferably has a pre-transfer charging device to charge the component toner image and to achieve some leveling of the surface voltage above the image bearing member 30 to improve transfer of the component image from the image bearing member 30 to the intermediate transfer member 12.

The image area then advances to a first transfer nip defined between the image bearing member 30 and the intermediate transfer member 12. The image bearing member 30 and intermediate transfer member 12 are synchronized such that each has substantially the same linear velocity at the first transfer nip 40. The component toner image is electrostatically transferred from the image bearing member 30 to the intermediate transfer member 12 by use of a field generation station 42 that is electrically biased to create sufficient electrostatic fields of a polarity opposite that of the component toner image to thereby transfer the component toner image to the intermediate transfer member 12. A pre-nip transfer blade 41 mechanically biases the intermediate transfer member 12 against the image bearing member 30 for improved transfer of the component toner image. The toner area of the intermediate transfer member 12 having the component toner image from the toner image producing station 22 then advances in the process direction.

After transfer of the component toner image, the image bearing member 30 then continues to move the image area past a pre-clean station 39 to condition the charge of the residual toner and the charge of the image bearing member 30 to enable improved cleaning of the image area. The image area then further advances to a cleaning station 43 for removal of the residual toner or debris from the image area. The operation of the cleaning station 43 completes the toner image production for each of the toner image producing stations 22, 24, 26, and 28.

The first component toner image is advanced at the image area from the first transfer nip 40 of the image producing station 22 to the first transfer nip of the second toner image producing station 24. Prior to entrance of the first transfer nip of the second toner image producing station 24, an image conditioning station 46 uniformly charges the component toner image to reduce stray, low or oppositely charged toner that would result in back transfer of some of the first component toner image to the subsequent toner image producing station 24. The image conditioning stations, in particular the image conditioning station prior to the first toner image producing station 22 also conditions the surface charge on the intermediate transfer member 12. At each transfer nip, the subsequent component toner image is registered to the prior component toner images to form a composite full color toner image after transfer of the final toner image by the fourth toner image producing station 28.

The intermediate transfer member 12 transports the composite toner image from the fourth toner image producing station 28 to a pre-transfer charge conditioning station 52. The conditioning station 52 conditions the toner charge for optimum transfer. When the intermediate transfer member 12 includes at least one insulating layer, the pre-transfer charge conditioning station 52 also levels the charge at the toner area of the intermediate transfer member 12. A second transfer nip is defined between the intermediate transfer member 12 and the transfuse member 50. A field generation station 42 and pre-transfer nip blade 44 engage the intermediate transfer member 12 adjacent the second transfer nip 48 and perform the same functions as the field generation stations and pre-transfer blades 44 adjacent the first transfer nips. The intermediate transfer member 12 and transfuse member 50 are preferably synchronized to have the generally same velocity in the second transfer nip 48. Transfer of the composite toner image in the second transfer nip 48 is accomplished by a combination of electrostatic, contact and/or heat-assisted transfer. The field generation station 42 and guide roller 74 are electrically biased to electrostatically transfer the charged composite toner image from the intermediate transfer member 12 to the transfuse member 50.

The transfer of the composite toner image at the second transfer nip 48 can be heat assisted if the temperature of the transfuse member 50 is maintained at a sufficiently high, optimized level and the temperature of the intermediate transfer member 12 is maintained at a considerably lower, optimized level prior to the second transfer nip 48. The mechanism for heat-assisted transfer is thought to be softening of the composite toner image during the dwell time of contact of the toner in the second transfer nip 48. The toner softening occurs due to contact with the higher temperature transfuse member 50. This composite toner softening results in increased adhesion of the composite toner image toward the transfuse member 50 at the interface between the composite toner image and the transfuse member. This also results in increased cohesion of the layered toner pile of the composite toner image.

The transfuse member 50 is guided in a cyclical path by guide rollers 74, 76, 78, 80. In a particular feature of the present invention, at least a portion of the path of the transfuse member 50 is made to define an elongated cavity within which a heat source 82 may be located for efficient heating of the rear surface of the transfuse member 50. In the illustrated embodiment, the portion of the path, and thus the cavity defined by it, is preferably provided as an elongated "U" shape. The portion of the path thus defined will loop the rear surface of the transfuse member 50 about the heat source to create an envelope within which there may be more efficient heating of the transfuse member in comparison to the prior art. Principal heating of the rear surface of the transfuse member 50 is thus provided by the heat source 82. Principal heating of the front surface of the transfuse member is provided by front surface heating element, preferably provided in the form of a heated roller 77, which operates by conductive heat transfer. Because of the substantial amount of wrap of the transfuse member 50 on the roller 77, such a conductive heat transfer is quite efficient and little or no heat is transferred to other components or structures. The heat source 82 is preferably formed of infra-red radiant heat elements positioned internally to the path defined by the transfuse member 50 as it is entrained over rollers 74, 77, and 76. Such a path may be considered herein to define a cavity that is primarily heated by virtue of the operation of the heat source 82.

Heat which is not absorbed directly by the transfuse member 50 and which migrates to the lower end of the heated cavity will assist in heating the guide roller 74, which in turn heats the transfuse member 50; unabsorbed heat which migrates to the upper end of the heated cavity will assist in heating the guide roller 76. Heat transferred to the guide rollers 74, 76 is in turn conducted to the transfuse member 50. As a result, substantially all of the output of the heat source 82 is quite efficiently transferred to the transfuse member 50. Furthermore, because the majority of the cavity is enclosed by the transfuse member 50 and the guide rollers 74, 76, little or none of the heat produced by the heat source 82 is lost to other components or structures. Accordingly, the heat source 82 is efficiently operated. Guide rolls 74 and 76 can also have auxiliary internal heat sources which, in some embodiments, may be useful to attain rapid thermal equilibration at startup. As those skilled in the art will observe, these improvements in heat conservation and efficiency will allow more uniform, accurate, and timely control of the elevated temperature of the transfuse member 50.

Accordingly, the benefits of the present invention better enable the use of a thick transfuse member 50. The intermediate layer of the transfuse member 50 is preferably thick to enable a high degree of conformance to rougher substrates 70 and to thus expand the range of substrate latitude allowed for use in the printer 10. The present invention also enables the use of a relatively high temperature on the transfuse member 50 prior to the second transfer nip 48, which creates advantages for the transfuse system.

The transfuse member 50 and a pressure roller 84 define a third transfer nip 86 therebetween. The composite toner image is transferred and fused to the substrate 70 in the third transfer nip 86 to form a completed document 72. The substrate 70 is also heated by the heating station 73 prior to entry of transfuse nip 86. Heat in the third transfer nip 86 from the substrate 70 and transfuse member 50, in combination with pressure applied by the pressure roller 84 acting against the guide roller 76 transfer and fuse the composite toner image to the substrate 70.

After stripping, the document 72 is directed to a selectively activatable simplex or duplex glossing station 110 and thereafter to a sheet stacker or other well know document handling system (not shown). The printer 10 can additionally provide duplex printing by directing the document 72 through an inverter 71 where the document 72 is inverted and reintroduced at about the middle of the pre-transfer heating station 73 for printing on the opposite side of the document 72.

A cooling station 66 cools the intermediate transfer member 12 after the second transfer nip 48 in the process direction. A cleaning station 54 engages the intermediate transfer member 12. The cleaning station 54 preferably removes untransferred toner and oil that may be deposited onto the intermediate transfer member 12 from the transfuse member 50 at the second transfer nip. A cleaning system 58 engages the surface of the transfuse member 50 past the third transfer nip 86 to remove any residual toner and contaminants from the surface of the transfuse member 50.

A gloss enhancing station 110 is preferably positioned down stream in the process direction from the third transfer nip 86 for selectively gloss enhancing the gloss properties of documents 72. The gloss enhancing station 110 has opposed fusing members 112, 114 defining a gloss nip 116 therebetween, which can be simplex or duplex.

What is claimed is:

1. A method for heating a transfuse member having an inner surface and an outer surface, comprising:

providing a plurality of guide rollers about which the transfuse member is guided in a path, wherein the transfuse member is guided about at least one of the guide rollers such that an elongated cavity is defined by first and second substantially plane parallel sections of the inner surface;

locating a heat source within the cavity; and operating the heat source for transferring heat to the inner surface of the transfuse member so as to provide efficient heating of the transfuse member.

2. The method of claim 1 wherein the transfuse member is provided in the form of a belt.

3. The method of claim 1 wherein the outer surface of the transfuse member is guided about a first guide roller and the inner surface of the transfuse member is guided about second and third guide rollers, such that the elongated cavity is defined between the inner surface and the second and third guide rollers.

4. The method of claim 3 wherein the first guide roller is operated for conductive heating the outer surface of the transfuse member.

5. The method of claim 1 wherein the operation of the heat source further comprises radiant emission of infrared heat.

6. The method of claim 1 wherein the portion of the path of the transfuse member that defines the cavity is provided in an elongated "U" shape.

7. A printing apparatus, comprising:

a toner image producing station for forming a toner image and having an image bearing member for supporting said toner image;

a transfuse station for generally simultaneously transferring and fusing said toner image to a substrate and having a transfuse member for supporting said toner image, the transfuse member having an inner surface and an outer surface;

an intermediate transfer member for transporting said toner image between said image bearing member and said transfuse member, and defining a first transfer nip with said image bearing member for transfer of said toner image, and a second transfer nip with said transfuse member for transfer of said toner image;

a plurality of guide rollers about which the transfuse member is guided in a path, wherein the transfuse member is guided about at least one of the guide rollers such that an elongated cavity is defined by first and second substantially plane parallel sections of the inner surface; and a heat source located within the cavity, operable for transferring heat to the inner surface of the transfuse member so as to provide efficient heating of the transfuse member.

8. The printing apparatus of claim 7, wherein the transfuse member is provided in the form of a belt.

9. The printing apparatus of claim 7, wherein the outer surface of the transfuse member is guided about a first guide roller and the inner surface of the transfuse member is guided about second and third guide rollers, such that the elongated cavity is defined between the inner surface and the second and third guide rollers.

10. The printing apparatus of claim 9, wherein the first guide roller is operable for conductive heating of the outer surface of the transfuse member.

11. The printing apparatus of claim 7, wherein the heat source further comprises a radiant emitter of heat.

12. The printing apparatus of claim 10 wherein the heat source further comprises an infrared element.

13. The printing apparatus of claim 7 wherein the portion of the path of the transfuse member that defines the cavity is provided in an elongated "U" shape.

* * * * *